United States Patent [19]

Kiser et al.

[11] Patent Number: 4,641,876

[45] Date of Patent: Feb. 10, 1987

[54] COIL EDGE PROTECTING COIL LIFTER AND INSERT

[75] Inventors: David G. Kiser, Franklin; Donald M. Spaulding, Cochranton, both of Pa.; Peter J. Wassmer, Bay Village, Ohio

[73] Assignee: Zurex Corporation, Cochranton, Pa.

[21] Appl. No.: 759,686

[22] Filed: Jul. 29, 1985

[51] Int. Cl.[4] ..... B66C 1/42

[52] U.S. Cl. ..... 294/86.4; 294/103.2

[58] Field of Search ..... 294/86.4, 103.2, 119.3, 294/88, 104, 106, 98.1, 92, 119.2, 86.32, 87.12, 99.1; 414/621, 729, 741, 742, 910

[56] References Cited

U.S. PATENT DOCUMENTS 2,021,529 11/1935 Tate ..... 294/99.1
2,675,261 4/1954 Egge ..... 294/103.2
3,001,812 9/1961 Anderson ..... 294/86.4
4,410,210 10/1983 de Sivry et al. ..... 294/119.3

*Primary Examiner*—James B. Marbert
*Attorney, Agent, or Firm*—Webb, Burden, Robinson & Webb

[57] ABSTRACT

A coil edge protecting coil lifter and insert. The insert mounts within a cavity through an aperture in the front wall of each lifter arm of the coil lifter. The edges of a coil contact with a protruding portion of an endless belt which extends through the aperture and outwardly beyond each front wall. A low-friction wear plate atop a backing plate is positioned behind the endless belt and causes the belt to protrude outwardly. The endless belt can be made to additionally protrude through an aperture in the rear wall of each lifter arm.

13 Claims, 5 Drawing Figures

COIL EDGE PROTECTING COIL LIFTER AND INSERT

BACKGROUND OF THE INVENTION

1. Field of the Invention

This invention relates to coil lifters and handling devices used for transporting coils of material such as steel, aluminum or the like. More specifically, this invention relates to coil lifters which protect the edges of the coil of material as the lifter arms are moved therealong. This invention can be incorporated into a coil lifter or assembled as an insert for mounting into each lifter arm of existing coil lifters and handling devices.

2. Description of the Prior Art

The coil lifters and handling devices used by many industries generally employ one of two lifting approaches. The approaches vary by the way in which a coil of material is positioned. Certain coils of material do not possess sufficient strength, especially soon after formation or rolling, to be laid on their edges. These coils are positioned, at rest, with the core through the center of the coil running horizontally.

The coil lifters used in transporting coils positioned in this manner typically employ the following approach. The coil lifter is suspended over the coil to be transported. The lifter arms of said coil lifter are moved apart a distance in excess of the overall coil width. The lifter arms are lowered about the coil of material until lifting surfaces at a lower end of each lifter arm are positioned for entry into the circular coil core ends. The lifter arms are moved together to close about the coil of material. Specifically, the lifter arms are effectively moved toward one another until the opposed front wall of each arm contacts with the edges of the coil therebetween. The lifter arms are then raised along the edges of the coil until the lifting surface of each arm contacts with upper curvature of each coil core end. Thereupon, the coil lifter and coil of material can be raised and moved about for transportation of the coil. Exemplary of such coil lifters are U.S. Pat. Nos. 3,002,779 and 3,771,666, For those coil lifters presently known in the art, there is normally no resultant damage caused by the initial contact of the front wall of each lifter arm with the edges of the coil. However, the edges of the coil are damaged as the lifter arms are raised therealong for the contacting of the lifting surfaces with the upper curvatures of each coil core end. Further damage to the edges results when the coil is subsequently lowered after transporation.

Attempts have been made to modify the opposed front walls of the lifter arms of a coil lifter. For example, a face plate was secured to the front wall of each lifter arm in U.S. Pat. Nos. 2,120,639 and 3,001,812. Because these face plates were permanently secured to the front wall of each arm, they would likewise cause damage to the edges of a coil placed therebetween upon the raising of the lifter arms.

Unfortunately, the edges of a coil of material, especially soon after formation or rolling, do not possess sufficient rigidity to withstand the abrading movement of the lifter arms therealong. The forces exerted on the edges of a coil by said movement can bend or permanently wrinkle the coiled material. Most often, the damaged edges of a coil cannot be easily repaired. Instead, the damaged areas are typically removed after transporation of the coil to the desired area for subsequent use.

Due to a general need for uniformity in coil size and due to the ease in cutting across and through all edges of a coil simultaneously, a substantial portion of each edge of a coil not damaged during transportation is also removed. Thus, the additional step of removing damaged edges is costly in terms of time, manpower and material wasted.

It is further known in the prior art to pad the arms of tongs which contact with fragile materials such as glass. U.S. Pat. No. 1,476,844. However, the addition of a padding material to the front wall of each lifter arm of known coil lifters would not minimize damage to the coil edges. The padding is still not responsive to the abrading movement of the arms along the edges of a coil.

SUMMARY OF THE INVENTION

This invention substantially reduces the damage to the edges of a coil caused by the movement of the lifter arms along and against said edges. This invention includes a contact means in the front wall of each lifter arm which moves relative to the arms. This contact means is caused to protrude outwardly a distance beyond the opposed front wall of each arm. Because the edges of a coil contact with the contact means rather than with the front walls themselves, forces normally exerted on said edges are minimized.

This invention can be incorporated into a coil lifter or assembled as an insert for mounting into each lifter arm of existing coil lifters. As a coil lifter, this invention comprises an upper housing adapted to be suspended over a coil of material, a pair of spaced lifter arms connected to and extending downwardly from said housing, means for effecting movement of said arms relative to each other to open and close said arms about the coil and the aforementioned contact means in the front wall of each arm for contacting with the edges of the coil.

The contact means of this invention includes an endless belt rotatably mounted within a cavity in the lower end of each lifter arm and a means for causing said belt to protrude through an aperture in each front wall a distance outwardly beyond the wall. In other embodiments of this invention, the endless belt is positioned around and engaged with a pair of spaced belt guide rollers. These guide rollers are rotatably mounted by a pin extending through the side walls of each arm or through a pair of spaced side plates. The side plates are mounted to the interior surface of at least one of the walls which comprise each lifter arm. In a preferred embodiment, the side plates are further supported by a stiffener plate positioned therebetween.

The protruding means of this invention includes a backing plate mounted to at least one interior surface of the walls which comprise each lifter arm, namely, the front wall, rear wall and side walls, The backing plate should be positioned behind and in contact with the inner surface of the endless belt. Most preferably, the surface of the backing plate in contact with said belt is mounted to a low-friction wear plate. The wear plate has leading and trailing edges which taper downwardly toward the backing plate for reducing the wear and tear on the inner surface of said belt and for causing the protrusion of the belt to start and end less abruptly.

In another embodiment of this invention, an additional backing plate and wear plate combination is mounted within the cavity in each lifter arm for causing a portion of the outer surface of each endless belt to protrude through an aperture in the rear wall of each arm a distance outwardly beyond said rear wall.

As an insert, this invention comprises a pair of spaced side plates, a pair of spaced belt guide rollers positioned between and rotatably mounted to said side plates, an endless belt positioned around and engaged with said guide rollers and a means for causing the outer surface of the belt to protrude outwardly a distance beyond at least one side of the straight path of the endless belt between said guide rollers. Alternatively, an additional protruding means can be added for causing the belt to protrude outwardly a distance beyond both sides of the straight path of the belt between said guide rollers.

The protruding means of the insert comprises a backing plate, mounted to and between the side plates of the insert and positioned behind and in contact with the inner surface of the endless belt. In a preferred embodiment, the surface of each backing plate in contact with the inner surface of the belt is further mounted to a low-friction wear plate. This wear plate has leading trailing edges which taper downwardly toward the backing plate beneath for the aforementioned reasons.

In the operation of the coil lifter of this invention, the upper housing is suspended over a coil of material to be transported. The lifter arms are effectively moved apart a distance in excess of the width of the coil. The arms are then lowered over the coil and brought towards each other so that a lifting surface at the lower end of each arm enters the circular coil core ends. As the arms brought together, the edges of the coil above the coil core contact with the protruding portions of the outer surface of the endless belt in each arm. None of the edges of the coil contact with the front wall of each lifter arm.

The lifter arms are raised upward until the lifting surface of each arm contacts with the upper curvature of each coil end. This upward movement of the arms is correspondingly transferred to a downward movement of the endless belt within each lifter arm. As the belt moves, a substantial portion of the outer surface of the belt in contact with the edges of the coil remains constant. However, some coil edges closest to the coil core will lose contact with the belt where it no longer protrudes due to the downward movement of the belt. Additionally, newly protruding portions of the outer surface of the belt, furthest from the lifting surface of each arm, will contact with additional edges of the coil for their downward movement in response to the raising of the lifter arms. Upon the lowering of the coil of material after transport, the movements between the endless belts in each lifter arm and the lifter arms are reversed for further preservation of the edges of the coil.

DESCRIPTION OF THE PREFERRED EMBODIMENTS

This invention is directed to coil lifters used in the transport of metal coils such as steel and aluminum. However, this invention may also be adapted for the lifters and handling devices of other coiled or sheet materials such as paper or the like.

Figure 1:
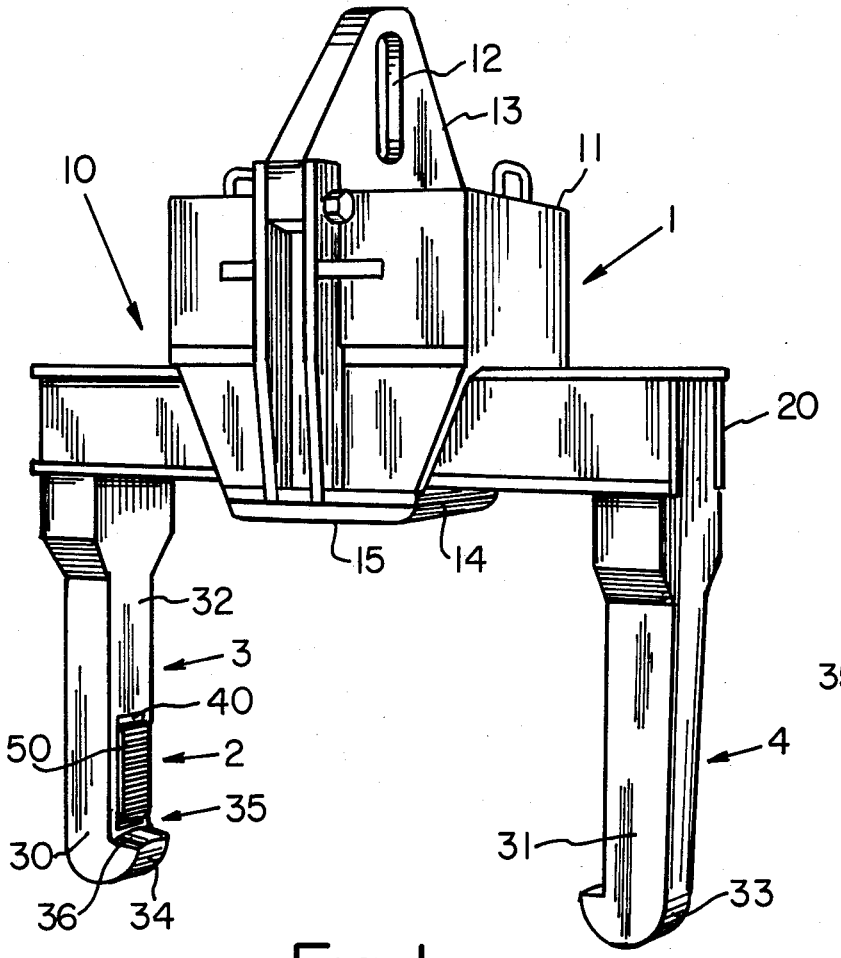
FIG. 1 is a perspective view of a coil edge protecting coil lifter.

A coil edge protecting coil lifter 1 incorporating this invention in the left lifter arm 3 is shown in FIG. 1. There is a corresponding edge protection insert in the right lifter arm 4 of the coil lifter 1 not visible in this perspective view. The coil lifter 1 includes an upper housing 10 from which the left lifter arm 3 and right lifter arm 4 are connected and downwardly suspended. The housing 10 includes a suspension portion 11 and an upward extension 13. The upper extension 13 has an eyelet 12 through which a chain or the like can be threaded for suspending the coil lifter 1 over a coil of material. In a preferred embodiment, the lower pedestal 14 of the suspension portion 11 is covered with a soft, yielding material 15 for cushioning the side of a coil in potential contact therewith.

A lifter arm channel 20 extends horizontally through and outwardly beyond the lower half of the suspension portion 11 of the coil lifter 1. The left lifter arm 3 and right lifter arm 4 are connected to and extend downwardly from this channel 20. Both lifter arms are slidably mounted to move within the channel 20. Together, the lifter arms and channel 20 form a fabricated unit. Alternatively, one of the arms may be slidably mounted within the channel 20 with the other arm permanently attached.

In this particular embodiment, the left lifter arm 3 and right lifter arm 4 are attached to corresponding racks, not shown, within the lifter arm channel 20. These racks are joined together by a commonly known pinion gear, also not shown, so that the turning of the pinion gear determines the mutual movement of the racks and lifter arms towards and away from one another. By the rotation of this pinion gear, the lifter arms can be made to open and close about a coil of material.

In the particular embodiment shown in FIG. 1, each lifter arm includes a pair of side walls, 30 and 31 respectively, a front wall 32 and a rear wall 33 opposite the front wall, joined together along adjacent edges to form an elongated, rectangular structure. Lifting surfaces 34 protrude inwardly from the lower end 35 of the front wall 32 of each lifter arm. These lifting surfaces 34 enter the coil core ends for eventual raising of the coil of material. Preferably, the lifting surface 34 has a convex curvature 36 along the top of the portion extending beyond and perpendicular to the front wall 32. This curvature 36 corresponds to the upper curvature at each circular coil core end.

The front wall 32 of each lifter arm has an aperture 40 at a lower end slightly above the lifting surface 34. This aperture allows for access into a cavity in the lower end of each lifter arm. Within this cavity, the contact means or, more specifically, the edge protection insert 2 is rotatably mounted. The insert 2 is positioned within the cavity so that a portion of the outer surface of an endless belt 50 protrudes through the front wall aperture 40 a distance outwardly beyond the front wall 32.

The outer surface of the endless belt should protrude on the order of $\frac{1}{8}$ inch to $\frac{1}{2}$ inch outwardly beyond the front wall for contact with the coil edges. Most preferably, the belt should protrude $\frac{1}{4}$ inch beyond the front wall of each arm. This protruding portion of the endless belt 50 contacts with the edges of a coiled material so as to prevent any contact of the edges of the coil with the front wall 32 of each lifter arm. Most preferably, the outer surface of the endless belt 50 is flat and smooth for maximizing coil edge protection.

Figure 2:
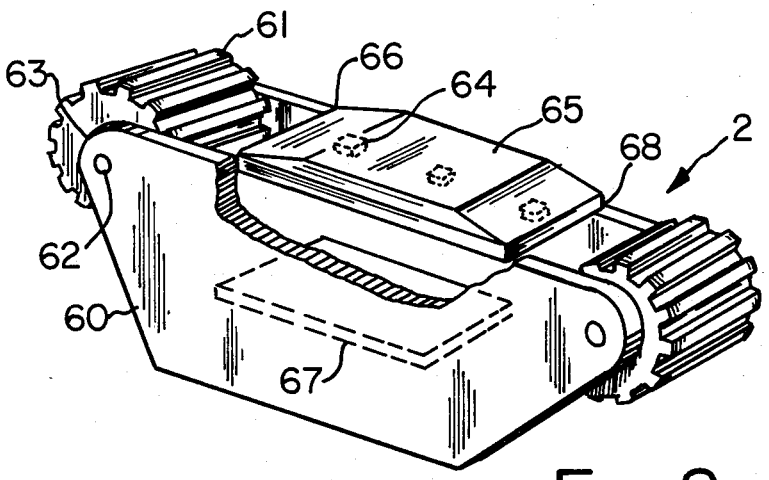
FIG. 2 is a perspective, cutaway view of an edge protection insert with the endless belt removed.

The edge protection insert 2 of this invention is shown in FIG. 2 with a portion of the side plates 60 cutaway and the endless belt removed. This insert 2 is adapted to be mounted to at least one interior surface of the front wall 32, rear wall 33, and side walls 30 and 31 which comprise each lifter arm. Alternatively, the insert 2 may be spring mounted for further coil edge protection.

Figure 4:
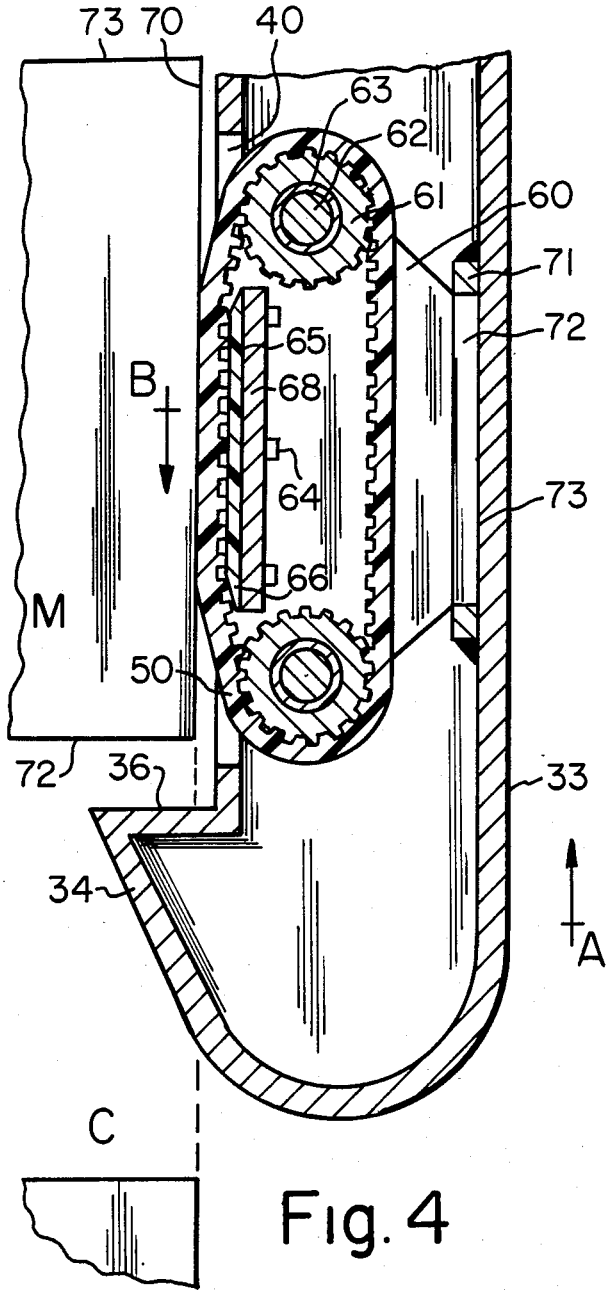
FIG. 4 is a section taken along line IV—IV in FIG. 3.
Figure 5:
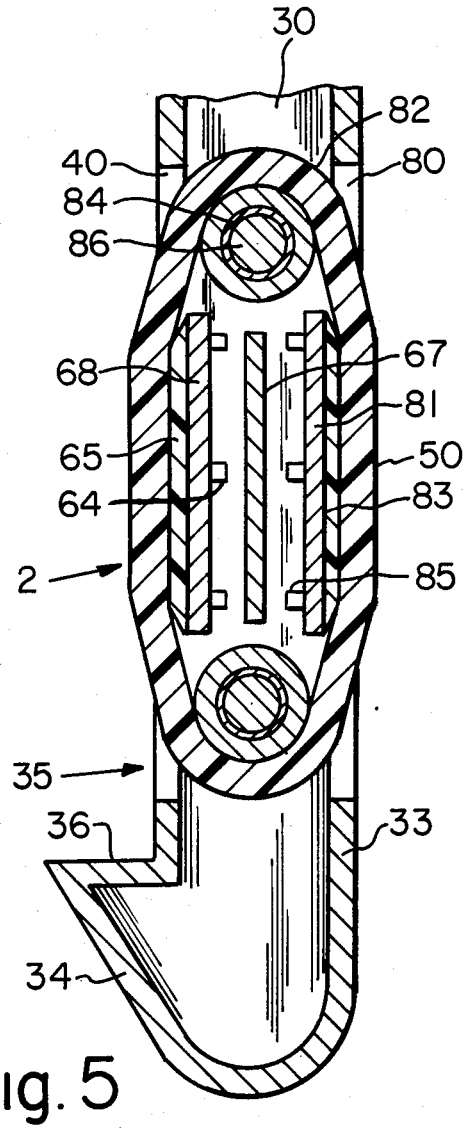
FIG. 5 is a cross section of a coil edge protecting coil lifter arm having dual belt protrusions.

A pair of spaced belt guide rollers 61 are rotatably mounted between said side plates 60 in the edge protecting insert 2. The guide rollers 61 are mounted by a pair of pins 62, each of which extends through the side plates 60 and a guide roller 61. Most preferably, a bushing 63 runs through the core of each guide roller 61 for easier rotation of the guide roller thereon. The outer surface of these guide rollers 61 are shaped to correspond to the inner surface of the endless belt 50 employed in this invention. The endless belt, removed for better illustration of FIG. 2, can have an inner surface shaped like any of the belts presently known and used in the automotive industry provided that the outer surface of the belt, for contacting with the edges of a coil, remains flat and smooth. The inner surface of the belt can be toothed, as shown in FIG. 4, or flat or V-shaped as shown in FIG. 5. The outer surface of each guide roller 61 should be correspondingly shaped to engage with the inner surface of the endless belt 50.

Regardless of the shape of the inner surface of the endless belt, this invention requires that a portion of the outer surface of the belt protrude through an aperture 40 in the front wall 32 of each lifter arm. This protruding portion will contact with the edges of a coil and move in either direction responsive to the movement of the arms for the raising and lowering of a coil. The protruding portion of the belt 50 should extend a distance outwardly beyond one side of the straight path of the belt around said guide rollers. With the addition of a second backing plate and modified side plates, the endless belt 50 can protrude outwardly beyond both sides of the straight path of the belt around and between said guide rollers.

A backing plate 68, in FIG. 2, constitutes the protruding means in this invention. Said backing plate is mounted to at least one interior surface of the walls which comprise the lifter arm. The backing plate 68 is positioned behind and in contact with the inner surface of the endless belt 50. In addition to causing a portion of the outer surface of the endless belt to protrude, the backing plate 68 serves to reduce the strain on the guide rollers 61 which would result if the weight of the coil would be rest solely thereupon. In the embodiment of this invention shown in FIG. 2, the backing plate 68 is mounted between the side plates 60 by a plurality of backing plate support wedges 64, shown in dotted lines in FIG. 2. These wedges 64 are generally L-shaped and mounted to the interior of each side plate 60.

In the preferred embodiment of this invention, a low-friction wear plate 65 is mounted to the surface of each backing plate which contacts with the inner surface of the endless belt. The wear plate 65 has leading and trailing edges 66 which taper downwardly toward the backing plate beneath. This tapering of the edges 66 of the wear plate in the direction of belt movement reduces the wear and tear of the inner surface of said belt over said wear plate and further causes the protrusion of the endless belt to start and end less abruptly.

In a particular embodiment of this invention, at least one stiffener plate 67 is positioned between and mounted to said side plates 60. This stiffener plate 67 serves to further strengthen the coil edge protection insert for accommodating various weights of coils of material.

Figure 3:
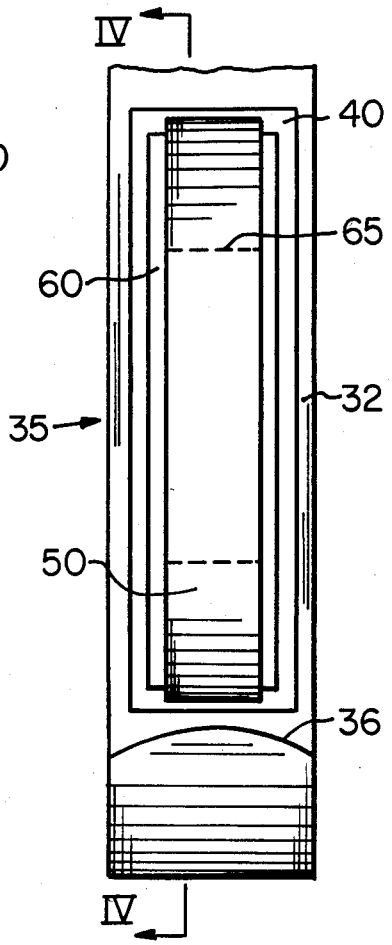
FIG. 3 is a front view of the lower portion of the left lifter arm shown in FIG. 1.

A front view of the lower portion 35 of a lifter arm having an edge protecting insert 2 is shown in FIG. 3. As can be seen by this view, the contact means/edge protection insert 2 is mounted within a cavity in the arm through the aperture 40 in the front wall 32, slightly above the convex curvature 36 of the lifting surface 34. Only the endless belt 50 and the side plates 60 of the insert 2 can be seen from this angle. However, the outline of the wear plate 65 behind the endless belt 50 is shown in dotted lines in FIG. 3 to show the approximate area of the outer surface of the belt that protrudes through the aperture 40 a distance outwardly beyond the front wall 32.

In FIG. 4 a section of FIG. 3 taken along lines IV—IV, the area of a coil edge 70 that contacts with the protruding portion of the endless belt is shown. In this particular embodiment, the edge protection insert 2 is mounted between spacers 71 on the interior of the rear wall 33 of each lifter arm. The side plates 60 are attached to a common shear plate 72. This shear plate 72 serves to transmit forces from the weight of a coil of material from the belt 50, through the backing plate 68 and stiffener plate 67, through the side plates 60 and ultimately to the lifter arms. For proper spacing of the insert 2 within each lifter arm, shim plates 73 are added between the spacers 71 and parallel to the rear wall 33.

In the embodiment shown in FIG. 4, the spaced belt guide rollers 61 are shown having toothed outer surfaces which correspond to the toothed inner surface of the endless belt 50. The guide rollers 61 are each rotatably mounted through the side plates 60 by a pin 62 extending through a bushing 63 in the center of each guide roller 61.

In FIG. 5, an alternative embodiment of this invention is shown. In this cross-sectional view of the lower end of each lifter arm 35, the endless belt 50 is caused to protrude through an aperture 40 in the front wall 32 of the lifter arm and additionally through an aperture 80 in the rear wall 33 of each arm. The latter protrusion is caused by the second backing plate 81 mounted to at least one interior surface of the walls which comprise the lifter arm for positioning behind and in contact with the inner surface of the belt 50.

In FIG. 5, the backing plates are positioned between a pair of V-shaped belt guide rollers 82 with each backing plate covered by a wear plate 65 and 83 respectively. As shown, the guide rollers 82 are rotatably mounted to and between the side walls of each lifter arm. Side plates are eliminated from this embodiment. Instead, the guide rollers 82 are spaced in the cavity in the lower end of each arm and mounted by a pin 86 extending through a bushing 84 in the center of each guide roller 82. In the absence of side plates, the backing plates 68 and 81 are directly mounted to and between the side walls of each lifter arm by a plurality of L-shaped wedge supports 85. A stiffener plate 67 for further strengthening of the lifter arm can be positioned between said side walls for mounting in a similar manner. The stiffener plate embodiment of FIG. 5 still allows for the transmittal of forces of the coil weight and the belt 50 to each lifter arm, though in a more direct manner.

FIG. 4 in conjunction with FIG. 1, best illustrates the operation of this invention. The upper housing 10 is suspended over a coil of material M having a coil core C running horizontally therethrough. The lifter arms and channel 20 are moved apart to exceed the overall coil width. The lifter arms must be opened a sufficient distance to allow the lifting surfaces 34 at the lower end of each arm to also clear the edges of the coil. Thereupon, the coil lifter arms are lowered about the coil until each lifting surface 34 is positioned for entry into the coil core ends.

Should the coil be of sufficient thickness such that the upper end of the coil 73 contacts with the lower pedestal 14 of the upper housing 10, a soft, yielding material 15 is attached thereto for additional cushioning.

As the lifter arms are effectively moved towards each other to close about the coil, the upper edges 70 of the coil of material will come in contact with the protruding, outer surface of the endless belt 50 of each arm. None of the coil edges will contact with the front wall 32 of each arm.

Before the coil can be raised for transportation, the lifter arms must first be raised so that the convex curvature 36 at the top of each lifting surface 34 contacts with the upper curvature of each coil core end 72. As lifter arms are raised, in the direction of arrow A in FIG. 4 for this purpose, the coil edges 70 force the protruding portion of the outer surface of the endless belt 50 to correspondingly move downward, in the direction of arrow B in FIG. 4. An additional area of the endless belt 50 is pulled over the wear plate 65 and backing plate 68 causing it to protrude and contact with additional coil edges. As this lifter arm movement is relative to the movement of the endless belt, substantial portions of the coil edges that initially contact with the endless belt remain constant. Thereby, abrading movements of the lifter arms against the coil edges are minimized and less damage results. The reverse movement of the edges along the belt occurs upon the lowering of the coil after transport.

Having presently described the preferred embodiments of this invention, it is to be understood that it may be otherwise embodied within the scope of the appended claims.

I claim:

1. A coil lifter adapted to lift a coil having a coil core, said lifter comprising:

an upper housing adapted to be suspended over a coil of material;

a pair of spaced lifter arms connected to and extending downwardly from said housing, each of said lifter arms having a front wall opposed to each other and a lifting surface at a lower end of each arm adapted to fit within a coil core;

means for effecting movement of said arms relative to each other to open and close said arms about a coil; and means at said front wall of each arm for contacting the edges of a coil located between the front walls of said lifter arms, each of said contact means being movable along with the edges of a coil relative to the lifter arm on which the contact means is mounted, whereby forces exerted on the edges of a coil as said front walls of said lifter arms are moved along said coil edges are minimized to minimize damage to the coil edges.

2. The coil lifter of claim 1 wherein said means includes:

an endless belt rotatably mounted within a cavity in the lower end of each arm, said belt being rotatable in either direction of movement of said arms along the edges of a coil; and means for causing an outer surface of said belt to protrude through an aperture in said front wall a distance outwardly beyond said front wall.

3. The coil lifter of claim 2 wherein each arm includes a pair of spaced and opposed side walls and said contact means in each arm further includes:

a pair of spaced belt guide rollers rotatably mounted between said side walls, with said belt positioned around and engaged with said guide rollers; and a pair of pins, each of said pins extending through said side walls and one of said guide rollers.

4. The coil lifter of claim 3 wherein said contact means further includes:

a pair of spaced side plates mounted to at least one interior surface of said side walls with each of said guide rollers rotatably mounted between said side plates by one of said pins extending through said side plates.

5. The coil lifter of claim 2 wherein each lifter arm has a rear wall opposed to said front wall and said contact means further includes means for causing the outer surface of said belt to protrude through an aperture in said rear wall a distance outwardly beyond said rear wall.

6. The coil lifter of claim 5 wherein each arm includes a pair of spaced and opposed side walls and each protruding means includes a backing plate mounted to at least one interior surface of said side walls, said backing plate being positioned behind and in contact with an inner surface of said belt.

7. The coil lifter of claim 6 wherein each protruding means further includes:

a low-friction wear plate mounted to a surface of each backing plate in contact with the inner surface of said belt, each wear plate having leading and trailing edges which taper downwardly toward each backing plate.

8. The coil lifter of claim 7 wherein each protruding means further includes at least one stiffener plate positioned between and mounted to said side walls.

9. A coil edge protection insert adapted to be mounted within a cavity in a lower end of each lifter arm of a coil lifter, said insert comprising:

a pair of spaced side plates;

a pair of spaced belt guide rollers positioned between said side plates and rotatably mounted thereto;

an endless belt positioned around and engaged with said guide rollers; and means for causing an outer surface of said belt to protrude a distance outwardly beyond a first side of a straight path of said path between said guide rollers.

10. The coil edge protection insert of claim 9 further including means for causing an outer surface of said belt to protrude a distance outwardly beyond a second side of the straight path of said belt between said guide rollers.

11. The coil edge protection insert of claim 10 wherein each protruding means includes:

a backing plate mounted between and to said side plates, said backing plate being positioned behind and in contact with an inner surface of said belt.

12. The coil edges protection insert of claim 11 wherein each protruding means further includes:

a low-friction wear plate mounted to a surface of each backing plate in contact with the inner surface of said belt, each wear plate having leading and trailing edges which taper downwardly toward each backing plate.

13. The coil edge protection insert of claim 9 which further includes:

at least one stiffener plate positioned between and mounted to said side plates.

* * * * *